United States Patent [19]

Kadlecik et al.

[11] 4,401,249

[45] Aug. 30, 1983

[54] AUTOMATIC BURSTER APPARATUS HAVING A DOUBLE BURSTING BAR

[75] Inventors: Jack Kadlecik, Macedon; Alvin M. Hill, Rochester, both of N.Y.

[73] Assignee: Burroughs Corporation, Detroit, Mich.

[21] Appl. No.: 335,421

[22] Filed: Dec. 29, 1981

[51] Int. Cl.[3] ..... B65H 35/10

[52] U.S. Cl. ..... 225/97; 225/100

[58] Field of Search ..... 225/100, 97, 98, 4; 270/52.5

[56] References Cited

U.S. PATENT DOCUMENTS

| | | | |
|---|---|---|---|
| 3,338,487 | 8/1967 | Schutz | 225/100 |
| 3,667,663 | 6/1972 | Kacmarcik et al. | 225/100 |
| 3,991,924 | 11/1976 | Schueler | 225/100 |
| 4,118,022 | 10/1978 | Rayfield et al. | 270/52.5 |
| 4,269,341 | 5/1981 | Polko | 225/100 X |

*Primary Examiner*—Frank T. Yost

*Attorney, Agent, or Firm*—David G. Rasmussen; Kevin R. Peterson; Edmund M. Chung

[57] ABSTRACT

An apparatus for automatic bursting of perforated continuous forms is disclosed. The apparatus comprises first and second feeder means which may comprise two pairs of rotating rollers with tensioning means being provided by rotating the roller pairs at a slight speed differential. The apparatus also includes releasing means for intermittently releasing the feeding action of the first feeder means or roller pair. The releasing means may be provided by a flat area on the surface of one of the low speed rollers for releasing the nip in the low speed rollers to allow the forms to slip and uncrinkle. The apparatus also includes first and second forms separation means which cooperate with perforations in the forms to separate the forms, the first separation means acting when no immediately preceding forms slippage has occurred and the second separation means acting when immediately preceding forms slippage has occurred. The first and second separation means may comprise, respectively, a first burster blade and a second burster blade spaced a small distance downstream from the first burster blade.

11 Claims, 6 Drawing Figures

AUTOMATIC BURSTER APPARATUS HAVING A DOUBLE BURSTING BAR

BACKGROUND OF THE INVENTION

The invention relates to the field of automatic bursting of perforated continuous forms. More particularly, the invention relates to an improvement of an apparatus for bursting forms which includes means for achieving forms uncrinkling through allowing forms slippage and means for accomplishing forms separation in the event of forms slippage.

In well known prior art bursting apparatus, a pair of high speed rollers and a pair of low speed rollers coact with a bursting blade to achieve separation along the preweakened zones of continuous paper forms. In such devices the continuous forms would be drawn between the upper and lower low speed rollers as they rotated. The forms could then be propelled beneath the burster bar and thence to the rotating upper and lower high speed rollers. At this point the speed differential between the high speed and low speed rollers would cause the forms to be tightly stretched. The placement of the bursting bar would be set to cause the preweakened zone of the continuous forms to arrive at a point directly beneath the bursting area of the bursting bar at the moment of maximum forms stretch. The perforation of the forms would be pushed tauntly against the bursting area of the bursting bar, thus initiating a line of separation along the perforations of the continuous forms. When separation would be completed, the high speed rollers would cause the separated form to be ejected toward a stacking means. The continuous forms would then be propelled to the upper and lower high speed rollers for bursting along the next line of perforation.

An improvement disclosed in U.S. Pat. No. 4,118,022 is to provide two pairs of flat areas formed into the bearing surface of the upper roller of the low speed roller pair which first receives the forms. The flat areas improve the reliability of the forms feeding process by enabling removal of crinkles which frequently occur in the forms as they pass through the rollers. When a flat area on the upper roller faces the lower roller, the nip for gripping and feeding the forms defined by the mating upper and lower rollers is released, allowing the forms to slip and remove crinkles. In practice, however, it has been found that a disadvantage of having such flat areas is that when the forms slip, the preweakened zones slip past the burster bar such that the perforated zone is no longer at the right position with respect to the bursting bar for separation to occur. This results in jamming of the bursting apparatus and the necessity of stopping the system and unjamming it by hand.

SUMMARY OF THE INVENTION

It is therefore, an object of the invention to provide a bursting apparatus having an improved bursting blade which can accomplish bursting of continuous forms when slippage occurs due to uncrinkling of the forms at a flatted roller.

It is another object to provide bursting apparatus which minimizes jamming of the forms in the roller pairs.

It is yet another object of the invention to provide bursting apparatus which accomplished more consistent bursting of continuous forms.

These, and other objects of the invention, are achieved by providing a bursting apparatus having a first feeder means for advancing continuous forms from a supply tray, second feeder means for receiving said continuous forms from said supply tray and advancing the burst forms to a stacking device, tensioning means for tensioning the forms between the first and second feeder means, releasing means for intermittently releasing the feeding action of the first feeder means such that crinkles in said continuous forms may be removed, first forms separating means disposed at a point between first and second feeder means for cooperating with preweakened zones in said continuous forms to burst said forms when no uncrinkling of said continuous forms has occurred immediately prior to said bursting, and second forms separating means disposed at a point between said first and second feeder means for cooperating with preweakened zones in said continuous forms to burst said forms when uncrinkling of said continuous forms has occurred immediately prior to said bursting.

DESCRIPTION OF THE PREFERRED EMBODIMENT

Figure 1:
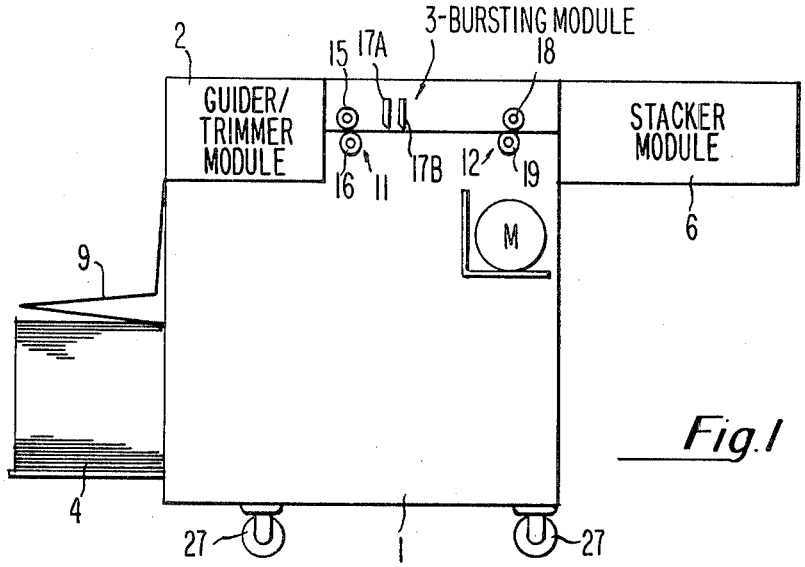
FIG. 1 is an idealized side view of the bursting apparatus of the present invention showing the relationship of the novel bursting unit of the instant invention to the guide/trimmer module and the stacker module of a typical bursting apparatus.

Referring to FIG. 1 of the drawings, there is shown an idealized side view of a continuous forms bursting apparatus having a frame and cabinet 1, resting on coasters 27, generally four in number. From the stacking tray 4, continuous forms 9 would enter the guider/-trimmer module 2, shown in block diagram form, and pass to the bursting module shown generally at 3. The continuous forms 9 pass through the first feeder means 11 which preferably comprises vertically tilted linearly adjustable low speed rollers denoted at 15 and 16. The forms pass under first and second separating means 13 and 14 which preferably comprises bursting blades 17A and 17B respectively and then enter into the second feeder means 12 which preferably comprises vertically tilted fixed high speed rollers denoted at 18 and 19. Tensioning means are provided through the above-described vertical tilting of the roller pairs 15, 16, and 18, 19 and through the speed differential between the low speed rollers 15 and 16 and the high speed rollers 18 and 19. This arrangement causes stresses to be built up along the preweakened zones of the continuous forms 9. The spacing between the high speed and low speed units is normally adjusted so these preweakened zones occur directly below the first blade 17A. The high speed and low speed rollers are driven by a series of belts and pulleys (not shown) by motor M. Burst forms are ejected into stacker module 6. An example of a loading tray, guide/trim module, decollator unit to separate a carbon and one or more copies, and a stacker module which are compatible with the instant disclosed invention are contained in U.S. Pat. No. 4,118,022.

Figure 2:
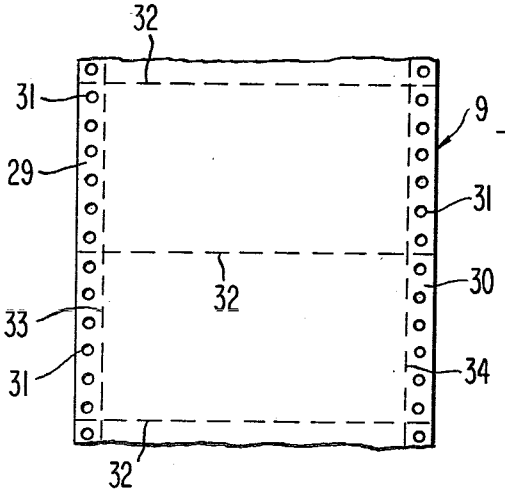
FIG. 2 shows an example of a typical sprocketed continuous form which may be burst by the apparatus of the instant invention.

An example of a typical continuous form, as might be used in the invention, is shown in FIG. 2. Continuous form 9 has a plurality of printing areas bounded by left and right hand margins 29 and 30, respectively, and a plurality of interform perforations of preweakened areas 32. Both left and right hand margins 29 and 30 may also be provided with marginal perforations 33 and 34 parallel to their respective left and right edges. Additionally, the forms may be provided with a plurality of equispaced sprocket holes 31 which are adapted to engage the well known tractor pin drives used in prior art bursters and data processing equipment. It will be noted, however, that the present invention does not require the presence of sprocket holes 31 on forms to be burst since the present invention may be used with guiding and feeding means adapted to handle both sprocketed and unsprocketed continuous forms as discussed in U.S. Pat. No. 4,118,022.

Figure 5:
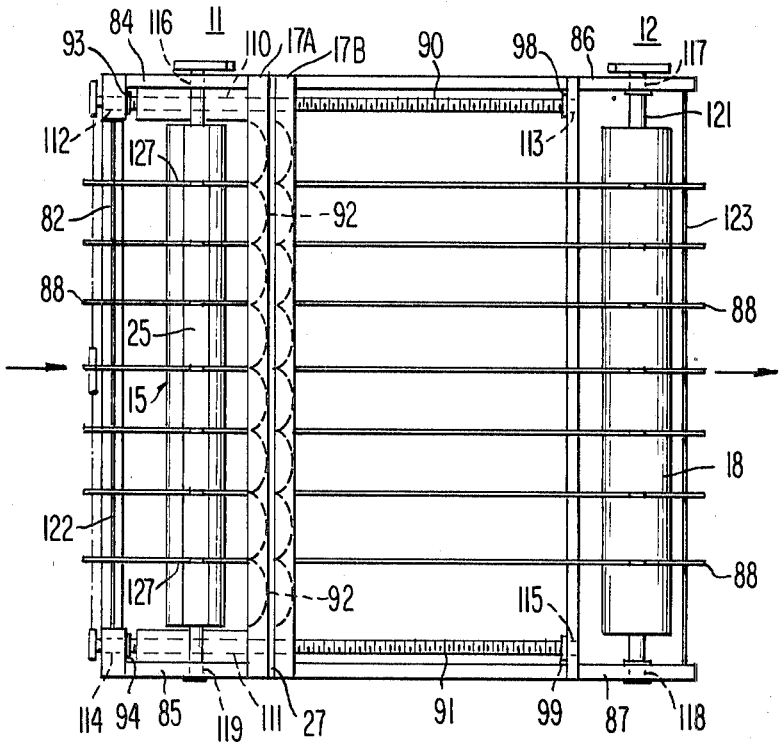
FIG. 5 is a view of the left end of the bursting apparatus shown in FIG. 3.
Figure 3:
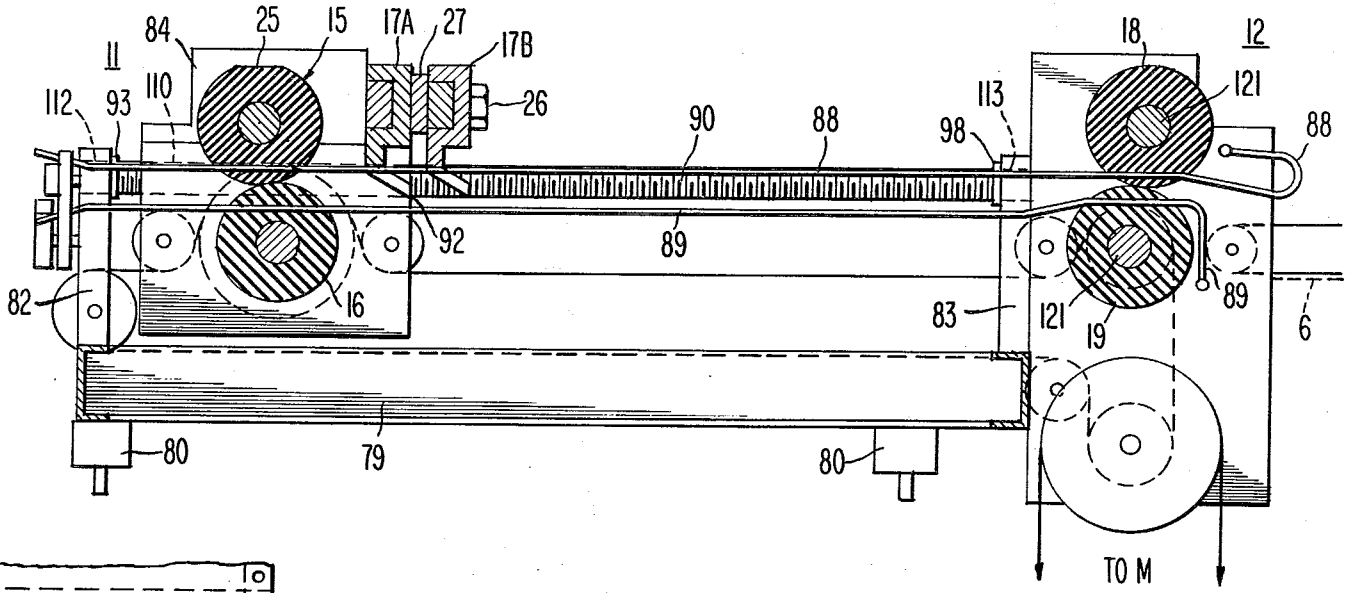
FIG. 3 is a detailed side view of the bursting apparatus of the present invention.
Figure 4:
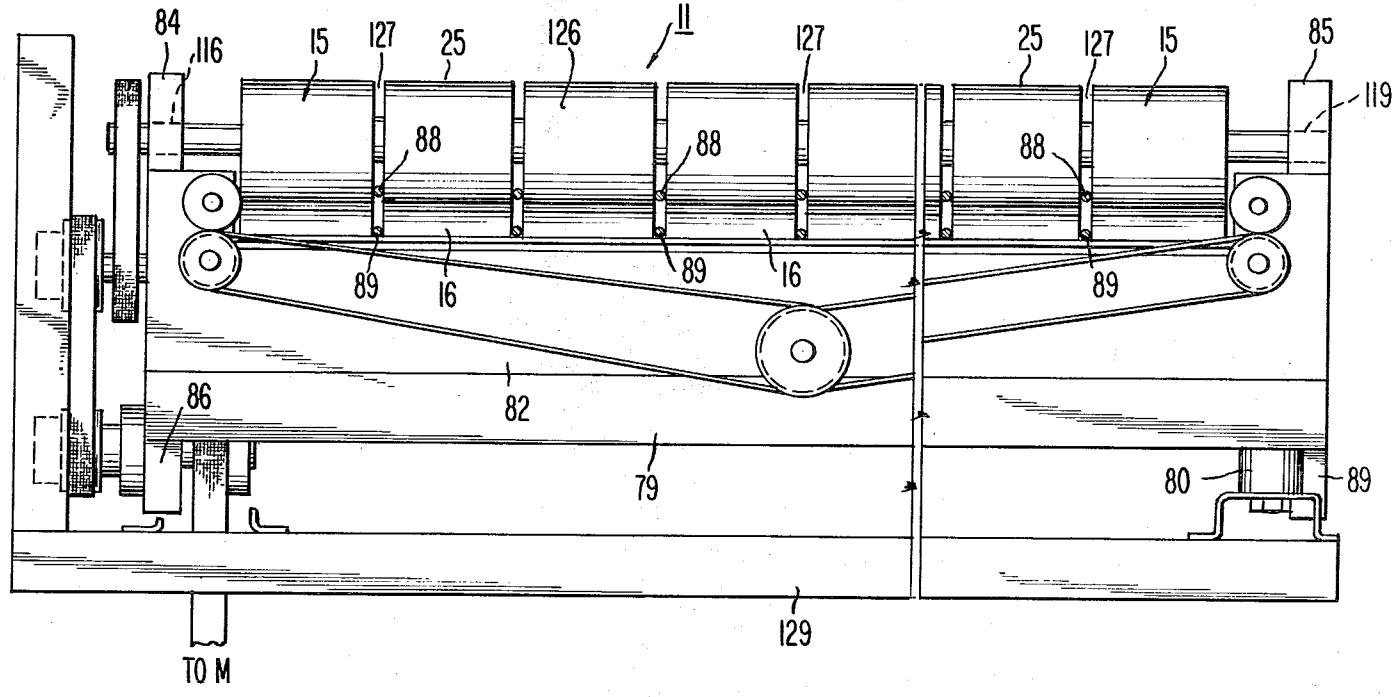
FIG. 4 is a top view of the bursting apparatus shown in FIG. 3.

With reference to FIGS. 3, 4, and 5, there are shown more detailed views of the bursting module of the instant invention. Base 79 rests on four cushioned mounts 80, which in turn are mounted on a rigid base 129, as shown generally in FIG. 5. Vertical supports 82 and 83 are mounted at opposite ends of base 79 and are mechanically joined by left and right threaded rods 90 and 91, respectively. Left side threaded rod 90 is rotatably joined at one end to thrust bearing 93 disposed at opening 112 of support 82, and at its other end to thrust bearing 98 disposed in opening 113 of support 83. Likewise, right side threaded rod 91 is rotatably joined at one end to thrust bearing 94 disposed in opening 114 of support 82, and at its other end to thrust bearing 99 disposed in opening 115 of support 83.

High speed rollers 18 and 19 are rotatably supported at the ends of their shafts 121 by openings 117 and 118 disposed in left and right fixed support blades 86 and 87, respectively. Left and right support plates 86 and 87 are mounted to opposite ends of support 83 and base 79 in a facing, spaced relationship.

Low speed rollers 15 and 16 are rotatably supported by openings 116 and 119 disposed in left and right movable carriage plates 84 and 85, respectively. Upper low speed roller 15 has a flat area 25 which runs substantially the entire length of roller 15. Left side carriage plate 84 has a threaded opening 110 which is adapted to engage the threads of left side threaded rod 90. Similarly, right hand side carriage plate 85 has a threaded opening 111 which is adapted to engage the threads of right side threaded rod 91. Threaded rods 90 and 91 may be of various diameters and threads per inch. The only requirement is that the threaded rods be of sufficient cross section to withstand the pressure placed parallel to their axis during the bursting of forms.

Figure 6:
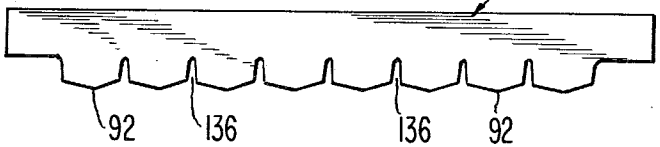
FIG. 6 shows a preferred form of bursting blade adapted for use in the invention.

Burster blade 17A, shown in more detail in FIG. 6, is fixedly mounted on carriage supports 84 and 85 on the exit side of the low speed rollers 5 and 16. Burster blade 17B, which is identical to burster blade 17A shown in FIG. 6, is mounted onto carriage plate 84 and 85 with two bolts 26 which go through spacer 27 and blade 17A to carriage plates 84 and 85. By varying the width of spacer 27, the spacing between blades 17A and 17B may be adjusted. Preferably, bursting blades 17A and 17B comprise a strip of hard, inpact-resistant material having a plurality of arcuate bursting surfaces 92 disposed on the lower edges of bursting blades 17A and 17B, with each arcuate bursting surface being separated from its neighbor by guide slots 136. Burster blades 17A and 17B may be fashioned from strip steel, aluminum, high-impact molded plastic, or the like. Of course, it is not necessary that bursting surfaces 93 be arcuate in shape for the bursting apparatus to function properly; however, it has been found the providing a bursting blade with a plurality of arcuately shaped bursting areas improves the overall reliability of the bursting process.

The type of bursting bar described above may be replaced by many other types of bursting bars without departing from the scope of the instant invention. For example, a burst bar comprising a shaft supporting two or more spherical plastic balls approximately one inch in diameter, as well as a flat edged blade design, may be used.

Referring back to FIG. 3, it can be seen that both the low speed rollers 15 and 16, and the high speed rollers 18 and 19, are mounted such that their shaft axes are disposed at a slight angle from the vertical. Preferably, this angle is approximately 8°, though it could range from 0° up to about 30°. This slight tilt in the axis of both the high and low speed rollers facilitates the guiding and improves the bursting action of the forms. Because of the tilt of the rollers, a form which is engaged between the low speed rollers 15 and 16 and the high speed rollers 18 and 19, would tend to be stretched slightly more across this upward surface than along its lower surface. This differential in upper and lower surface stretching of the form will tend to cause the form to begin separation along its perforations on the upward surface of the form thus concentrating the stretching forces along a very narrow portion of the form, as aided by the preferred brusting blade mentioned above. Rollers which are shown merely vertically mounted will tend to concentrate the stretching effect throughout the entire thickness of the form, resulting in higher bursting forces being necessary, greater noise, and less reliable bursting action.

The bearing surfaces 126 of rollers 15, 16, 18, and 19 are preferably composed of a hard, slightly compressable material having a good coefficient of friction. One such material, by way of example only, is neoprene rubber. Alternatively, the above mentioned rollers could be comprised solely of cold rolled steel, aluminum, or other hard materials if the bearing surfaces were appropriately roughened or scored to increase the grooving power.

As shown in FIG. 3, the first feeder means 11 is provided with releasing means shown generally at 24 which preferably comprises an upper low speed roller 15 with a flat area 25 formed into bearing surface 126 to help improve the reliability of the forms feeding process. The function of flat area 25 is to periodically release the nip in the low speed roller pair 15 and 16 to allow any crinkles which may have developed in the forms to be removed. The crinkles will be eliminated because the tension in the forms which exists due to the speed differential between the high speed rollers 18 and 19 and the low speed rollers 15 and 16 will cause the forms to snap and slip forward when the low speed roller nip is released. Alternatively, other arrangements of flat areas on the low speed roller pair could serve the function of allowing uncrinkling of the forms, for example as disclosed in U.S. Pat. No. 4,118,022.

Annular grooves 127 and burster blades slot 136 are adapted to receive in a noncontacting arrangement upper wire form guides 88 and lower wire form guides 89 as shown in FIGS. 4 and 5. Wire form guides 88 and 89 define an area between the upper low speed and high speed rollers and the lower low speed and high speed rollers through which the continuous forms may travel. Both upper and lower wire forms 88 and 89 are similar in construction. Each guide is comprised of a plurality of parallelly disposed stiff metal wires held in a spaced apart relationship by perpendicular tie wires 122 and 123 at the respective low speed and high speed ends. Of course it is not necessary that upper and lower wire form guides 88 and 89 be comprised of stiff metal wires, but could take the form of parallel metal strips or be composed of a plastic type material, rather than metal. Perpendicular tie wires 122 and 123 of upper and lower guides 88 and 89 are used to mount wire form guides 88 and 89 in a facing, spaced apart relationship in the low speed guides support 82 and high speed support 86 and 87. The upper and lower wire form guides are arranged such that the plurality of parallelly disposed wires are disposed parallel to the direction of travel of the continuous forms and that the plane of the upper and lower wire form guides is substantially parallel to the plane of the path of the continuous forms in a bursting module.

As is shown in FIG. 3, the low speed opening of wire forms 88 and 89 are spread apart slightly to more readily receive the entering continuous forms. A continuous form would be drawn between the upper and lower low speed rollers 15 and 16 as they rotated. The form would then be propelled beneath bursting blades 17A and 17B, each blade having a plurality of bursting areas 92 disposed thereon, and then to the rotating upper and lower high speed rollers 18 and 19. At this point, the speed differential between the high speed and low speed rollers would cause the forms to be tightly stretched. The bursting module may be adjusted as described below to cause the preweakened areas of perforations 32 of continuous forms 9, such as shown in FIG. 2, to arrive at a point directly beneath the bursting areas 92 of the first bar 17A of double bursting bar 17 at the moment of maximum stretch. The action of the oppositely tilted low and high speed rollers in conjunction with the path of the forms defined by upper and lower wire form guides 88 and 89 causes the perforation 32 of the forms to bear upward against the bursting areas 92 of bursting bar 17A, thus initiating a line of separation along perforations 32 of the continuous forms 9. When separation is complete, tilted high speed rollers 18 and 19 will cause the separated form to be ejected towards the stacking module shown only partially in FIG. 3. The upper and lower wire form guides 88 and 89 are shaped in a slight downward curve at the high speed end to help direct the burst forms downward towards the stacking means 6.

In operation, the distance between movable low speed rollers 15 and 16 and fixed high speed rollers 18 and 19 could be adjusted so as to place the arcuate bursting areas 19 and 22 of blade 17A, which, as described above, is attached to the low speed roller unit, directly over a preweakened zone of perforation disposed on a set of continuous forms fed into the bursting module. That is, the placement of bursting blade 17A would be set such that blade 17A could be directly over a perforation in instances where no uncrinkling and therefore no slippage of the continuous forms had occurred during the time immediately preceding the perforations nearing the burst blades. At the same time, the placement of blade 17B would be set such that blade 17B would be in a position to accomplish forms separation in cases where form slippage had immediately preceded the desired bursting action. The spacing between blades 17A and 17B would be determined by the width of spacer 27. Optimally, the second blade 17B would be spaced a distance apart from blade 17A whereby blade 17B would be directly over the line at which maximum forms slippage would carry the line of perforation. Appropriate scale or indicia means could be placed near or adjacent the arcuate bursting area 92 of the first bar of the double burster bar to allow an operator to more easily adjust the distance between the movable low speed roller and the bursting bars and the fixed high speed roller for different sized forms.

What is claimed is:

1. Bursting apparatus for continuous forms comprising:

first feeder means for advancing said continuous forms from a supply tray;

second feeder means for receiving said continuous forms from said first feeder means and advancing the burst forms to a stacking device;

tensioning means for tensioning said forms between said first and second feeder means;

releasing means for intermittently releasing the feeding action of said first feeder means such that crinkles in said continuous forms may be removed;

first separating means disposed at a point between said first and second feeder means for cooperating with preweakened zones in said continuous forms to burst said forms when no uncrinkling of said continuous forms has occurred immediately prior to said bursting; and, second separating means disposed at a point between said first and second feeder means for cooperating with preweakened zones in said continuous forms to burst said forms when uncrinkling of said continuous forms has occurred immediately prior to said bursting.

2. Bursting apparatus for continuous forms comprising:

a first pair of rotating rollers disposed to define a nip for advancing said continuous forms, at least one roller of said first pair having a flat area on a portion of its surface for releasing said nip to allow uncrinkling of said forms;

a second pair of rotating rollers disposed to define a nip for receiving said continuous forms from said first roller pair and for advancing said forms;

tensioning means for tensioning said forms between said first and second pairs of rollers;

first forms separating means disposed at a point between said first and second roller pairs for cooperating with preweakened zones in said continuous forms to burst said forms when no uncrinkling of said continuous forms has occurred immediately prior to said cooperation; and, second forms separating means disposed at a point between said first and second roller pins for cooperating with preweakened zones in said continuous forms to burst said forms when uncrinkling of said nip has occurred immediately prior to said cooperation.

3. Apparatus according to claim 2 wherein said first and second froms separating means respectively comprises a first burster blade and a second burster.

4. Apparatus according to claim 3 wherein said first and second burster blades are disposed substantially parallel to one another and substantially perpendicular to the direction of travel of said continuous forms.

5. Apparatus according to claim 4 wherein said substantially parallel first and second burster blades are adjustably spaced a small distance apart.

6. Apparatus according to claim 2 wherein said tensioning means comprises said first and second pairs of rollers disposed such that a plane passing through the axis of one of said pairs of rollers is angularly tilted from the vertical in an opposite rotational sense from a plane passing through the axis of the other said pair of rollers such that each said pair of rollers has a nip plane tangent to each roller but skewed with respect to the plane of travel of said forms between said first and second pairs of rollers, said second pair of rotating rollers being rotated at a higher speed than said first pair of rotating rollers.

7. Apparatus according to claim 6 wherein each roller in said first and second roller pairs is substantially tubular-shaped and the rollers in both said first and second roller pairs are disposed in a substantially contacting, facing relationship along said nip plane.

8. Apparatus according to claim 7 wherein said first and second roller pairs define a substantially horizontal path for said continuous forms.

9. Apparatus according to claim 8 wherein both said first and second roller pairs comprise an upper roller and a lower roller.

10. Apparatus according to claim 9 wherein said roller of said first pair of rotating rollers which includes said flat area is said upper roller.

11. In a bursting apparatus for continuous forms having a first pair of rotating rollers disposed to define a nip for advancing said continuous forms, at least one of said first pair having a flat area on a portion of its surface for releasing said nip to allow uncrinkling of the forms, a second pair of rotating rollers disposed to define a nip for receiving said continuous forms from said first roller pair and for advancing said forms, tensioning means for tensioning said forms between said first and second pairs of rollers, the improvement comprising first forms separation means disposed at a point between said first and second roller pairs for cooperating with preweakened zones in said continuous forms to burst said forms when no releasing of said nip has occurred immediately prior to said cooperation and second forms separation means disposed at a point between said first and second roller pairs for cooperating with preweakened zones in said continuous forms to burst said forms when releasing of said nip has occurred immediately prior to said cooperation.

* * * * *